US011085682B2

(12) United States Patent
Wang et al.

(10) Patent No.: US 11,085,682 B2
(45) Date of Patent: Aug. 10, 2021

(54) ONE METHOD TO MITIGATE VIBRATION AND SOUND LEVEL IN HEAT PUMP CHILLER WITH EVI FUNCTION

(71) Applicant: Carrier Corporation, Farmington, CT (US)

(72) Inventors: Weijuan Wang, Shanghai (CN); Yilin Zhang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 96 days.

(21) Appl. No.: 16/300,229

(22) PCT Filed: May 4, 2017

(86) PCT No.: PCT/US2017/030981

§ 371 (c)(1),
(2) Date: Nov. 9, 2018

(87) PCT Pub. No.: WO2017/196626

PCT Pub. Date: Nov. 16, 2017

(65) Prior Publication Data

US 2019/0145680 A1 May 16, 2019

(30) Foreign Application Priority Data

May 9, 2016 (CN) ..... 201610299751.7

(51) Int. Cl.
*F25B 13/00* (2006.01)
*F25B 41/20* (2021.01)
(Continued)

(52) U.S. Cl.
CPC ..... *F25B 49/02* (2013.01); *F25B 13/00* (2013.01); *F25B 30/02* (2013.01); *F25B 41/20* (2021.01);
(Continued)

(58) Field of Classification Search
CPC .. F25B 2400/13; F25B 31/006; F25B 31/008; F25B 43/02; F25B 49/02; F25B 41/20;
(Continued)

(56) References Cited

U.S. PATENT DOCUMENTS 4,027,497 A * 6/1977 Thurman ..... F25B 13/00 62/156
4,633,681 A 1/1987 Webber
(Continued)

FOREIGN PATENT DOCUMENTS

CN 101169292 A 4/2008
CN 102062496 A 5/2011
(Continued)

OTHER PUBLICATIONS

International Search Report and Written Opinion for application PCT/US2017/030981, dated Jul. 13, 2017, 13 pages.
(Continued)

*Primary Examiner* — Cassey D Bauer
(74) *Attorney, Agent, or Firm* — Cantor Colburn LLP

(57) ABSTRACT

A heat pump system and a control method thereof. The heat pump system includes: a major heat exchange loop (100), including at least one compressor (110), a flow-path switching valve (120), a condenser (130), a first throttling element (140), an economizer (150), and an evaporator (160) that are connected sequentially to form a loop; and an air supply branch (200), which is connected from a flow path between the first throttling element and the economizer to an air supply inlet of the compressor, the air supply branch being provided with a switch valve (231) for preventing a gas-phase refrigerant from flowing back; where a pressure balance branch (300) is further included, which is connected
(Continued)

from the air supply branch at the upstream of the switch valve to a low-pressure gas-phase refrigerant side of the major heat exchange loop.

20 Claims, 1 Drawing Sheet

(51) Int. Cl.
*F25B 41/40* (2021.01)
*F25B 30/02* (2006.01)
*F25B 49/02* (2006.01)

(52) U.S. Cl.
CPC ..... *F25B 41/40* (2021.01); *F25B 2400/075* (2013.01); *F25B 2400/13* (2013.01); *F25B 2500/12* (2013.01); *F25B 2500/13* (2013.01); *F25B 2600/25* (2013.01)

(58) Field of Classification Search
CPC ..... F25B 41/40; F25B 13/00; F25B 30/02; F25B 2400/075; F25B 2600/25
See application file for complete search history.

(56) References Cited

U.S. PATENT DOCUMENTS

| | | | | |
|---|---|---|---|---|
| 5,157,933 | A * | 10/1992 | Brendel | F25B 1/10 62/196.4 |
| 6,199,399 | B1 | 3/2001 | Voorhis | |
| 6,202,438 | B1 * | 3/2001 | Barito | F04C 28/28 62/197 |
| 6,435,848 | B1 | 8/2002 | Minami et al. | |
| 7,114,349 | B2 | 10/2006 | Lifson et al. | |
| 8,047,011 | B2 | 11/2011 | Kawano et al. | |
| 8,459,051 | B2 | 6/2013 | Jeong et al. | |
| 8,959,951 | B2 | 2/2015 | Fujimoto et al. | |
| 9,279,608 | B2 | 3/2016 | Wakamoto et al. | |
| 2006/0005571 | A1 | 1/2006 | Lifson et al. | |
| 2009/0038322 | A1 | 2/2009 | Senf et al. | |
| 2010/0071391 | A1 * | 3/2010 | Lifson | F25B 9/06 62/115 |
| 2011/0036110 | A1 | 2/2011 | Fujimoto et al. | |
| 2014/0047852 | A1 | 2/2014 | Kim et al. | |
| 2014/0245777 | A1 * | 9/2014 | Katoh | F28F 9/0278 62/515 |
| 2014/0260388 | A1 | 9/2014 | Umeda et al. | |
| 2015/0354878 | A1 | 12/2015 | Yamashita | |

FOREIGN PATENT DOCUMENTS

| | | | |
|---|---|---|---|
| CN | 202660807 | U | 1/2013 |
| CN | 202813921 | U | 3/2013 |
| CN | 105074351 | A | 11/2015 |
| CN | 105258392 | A | 1/2016 |
| DE | 10055916 | A1 | 5/2002 |
| EP | 2587189 | A2 | 5/2013 |
| EP | 2792973 | A1 | 10/2014 |
| EP | 2863147 | A1 | 4/2015 |
| JP | H08284849 | A | 10/1996 |
| JP | 2008215697 | A | 9/2008 |
| WO | 20160026592 | A1 | 2/2016 |

OTHER PUBLICATIONS

Chinese Office Action for CN 201610299751.7, dated May 8, 2020, 9 pages.
European Search Report for Application No. 17723862.3; dated May 26, 2021; 4 Pages.

* cited by examiner

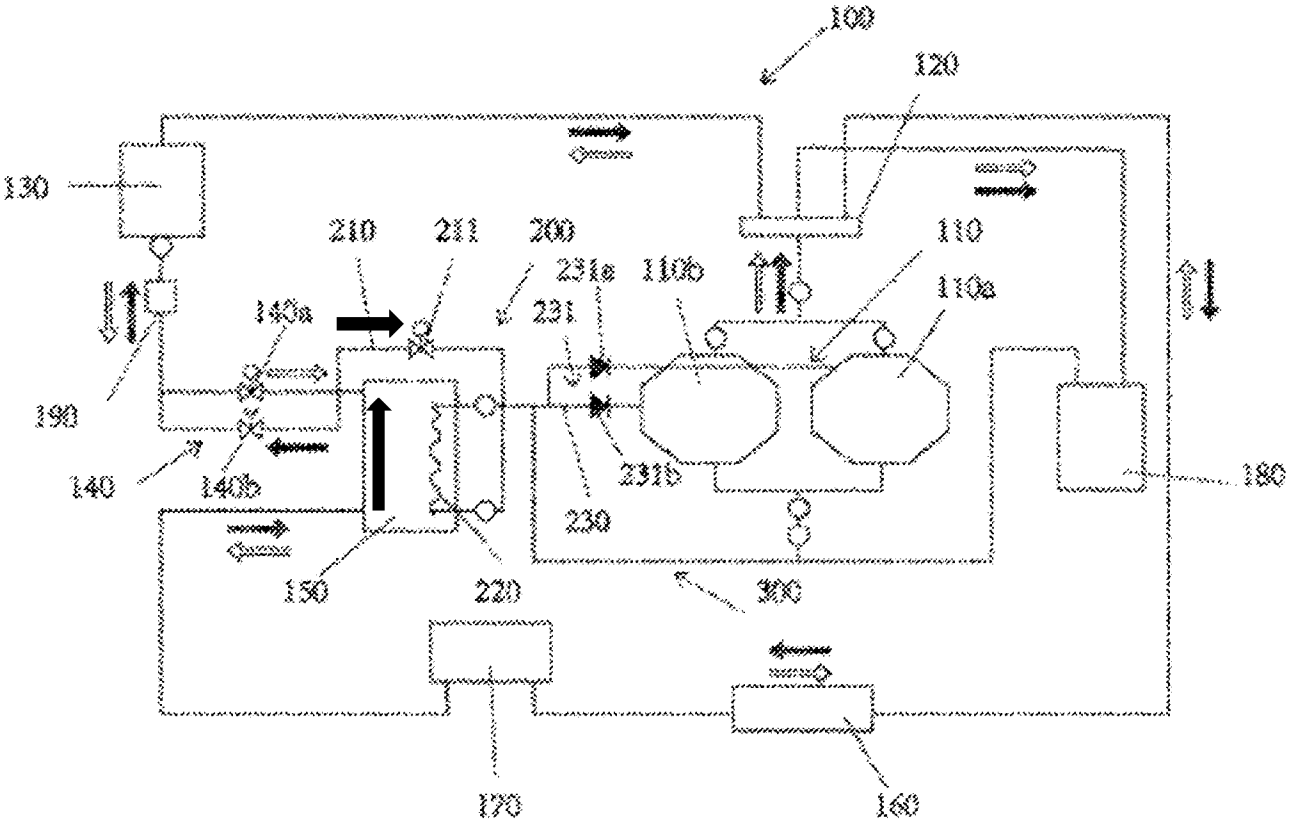
100
120
110
110a
110b
130
190
140
140a
140b
210
211
200
231
231a
231b
230
220
150
160
170
180
300

ONE METHOD TO MITIGATE VIBRATION AND SOUND LEVEL IN HEAT PUMP CHILLER WITH EVI FUNCTION

TECHNICAL FIELD

The present invention relates to the field of refrigeration, and more particularly, to a heat pump system having smaller vibration and noise and a control method thereof.

BACKGROUND ART

In a current refrigeration system using an air-supplying enthalpy-increasing compressor, an economizer is generally used to supply air for an intermediate stage of the compressor. Such an air supply branch generally includes a throttling element for throttling a refrigerant herein, a loop for exchanging heat with the economizer, and a check valve for preventing the refrigerant from flowing back from an air supply inlet of the compressor. When a heating mode is run, an air-supplying enthalpy-increasing operation is enabled, and at this point, the refrigerant may flow through the air supply branch into the air supply inlet of the compressor. When a refrigeration mode is run, the air supply branch may be turned off as required. At this point, medium-pressure refrigerant gas accumulated in the air supply branch will be blocked at an upstream side of the check valve in the branch. As refrigerant gas at a downstream side of the check valve has pressure fluctuation as the compressor works, a varying pressure difference exists between two sides of the check valve, and this may cause vibration of the check valve, and cause constant movement of a movable valve spool of the check valve. Therefore, large noise may be caused, affecting the service life of elements.

SUMMARY OF THE INVENTION

An objective of the present invention is to provide a heat pump system that can reduce valve vibration and noise in an air-supplying enthalpy-increasing loop.

Another objective of the present invention is to provide a control method of the heat pump system.

According to one aspect of the present invention, a heat pump system is provided, including: a major heat exchange loop, including at least one compressor, a flow-path switching valve, a condenser, a first throttling element, an economizer, and an evaporator that are connected sequentially to form a loop; and an air supply branch, which is connected from a flow path between the first throttling element and the economizer to an air supply inlet of the compressor, the air supply branch being provided with a switch valve for preventing a gas-phase refrigerant from flowing back; where a pressure balance branch is further included, which is connected from the air supply branch at the upstream of the switch valve to a low-pressure gas-phase refrigerant side of the major heat exchange loop.

According to another aspect of the present invention, a control method of a heat pump system is further provided, including: in a heating mode, enabling a major heat exchange loop to switch on a second flow direction and switch on an air supply branch; at this point, a refrigerant, after being compressed by a compressor, flowing through a flow direction switching valve to an evaporator for condensation and heat dissipation, and then flowing through an economizer; then, on one hand, the refrigerant being throttled by a first throttling element, being evaporated at a condenser for heat absorption, and returning to the compressor through the flow direction switching valve; on the other hand, the refrigerant, after being throttled by a second throttling element, flowing through the economizer and exchanging heat with the refrigerant flowing from the evaporator to the economizer, and then entering an air supply inlet of the compressor through a switch valve; and in a refrigeration mode, enabling the major heat exchange loop to switch on a first flow direction and switch off the air supply branch; at this point, on one hand, the refrigerant, after being compressed by the compressor, flowing through the flow direction switching valve to the condenser for condensation and heat dissipation, and after being throttled by the first throttling element, flowing through the economizer, being evaporated at the evaporator for heat absorption, and then returning to the compressor through the flow direction switching valve; on the other hand, the medium-pressure refrigerant accumulated in the air supply branch being throttled by a pressure balance branch and then flowing to a low-pressure gas-phase refrigerant side of the major heat exchange loop.

BRIEF DESCRIPTION OF THE DRAWINGS

FIG. 1 is a schematic diagram of a heat pump system according to an embodiment of the present invention.

DETAILED DESCRIPTION

As shown in FIG. 1, according to an embodiment of the present invention, a heat pump system is disclosed. The heat pump system includes a major heat exchange loop 100, an air supply branch 200, and a pressure balance branch 300. The pressure balance branch 300 is connected from the air supply branch 200 to a low-pressure gas-phase refrigerant side of the major heat exchange loop 100. In this configuration, when the air supply branch 200 is unnecessary and turned off, medium-pressure gaseous refrigerant blocked in the air supply branch 200 will be exported to the low-pressure gas-phase refrigerant side of the major heat exchange loop 100 through the pressure balance branch 300, and then it is sucked, together with the working refrigerant, into the compressor to participate in cycle. Therefore, the problems of vibration and noise caused by a pressure difference, between two sides of the switch valve in the air supply branch 200, which is caused by accumulation of the medium-pressure gaseous refrigerant in the air supply branch 200 are avoided. In addition, the exporting of this part of medium-pressure gaseous refrigerant can further improve the degree of superheat of the air intake of the compressor, being conducive to improving the low-temperature heating mode.

Specifically, the major heat exchange loop 100 includes at least one compressor 110, a flow-path switching valve 120, a condenser 130, a first throttling element 140, an economizer 150, and an evaporator 160 that are connected sequentially to form a loop. The air supply branch 200 is connected from a flow path between the first throttling element 140 and the economizer 150 to an air supply inlet of the compressor 110, and the air supply branch 200 is provided with a switch valve for preventing a gas-phase refrigerant from flowing back. In addition, the pressure balance branch 300 is connected from the air supply branch 200 at the upstream of the switch valve to a low-pressure gas-phase refrigerant side of the major heat exchange loop 100. As the refrigerant accumulated in the air supply branch 200 is at a medium pressure and is gaseous, connecting the pressure balance branch 300 to the low-pressure gas-phase refrigerant side of the major heat exchange loop 100 enables that the accumulated medium-pressure gas-phase refrigerant can be easily guided therein directly. As an example, the pressure balance branch 300 in FIG. 1 is connected to the air intake of the compressor 110, such that the refrigerant guided back to the major heat exchange loop 100 can be directly sucked into the compressor 110 to participate in working cycle, and the degree of superheat of the air intake of the compressor 110 is improved. In this case, when air supply and enthalpy increase are required, a part of refrigerant flowing out from the economizer is introduced into the air supply inlet of the compressor 110 through the air supply branch 200; when air supply and enthalpy increase are unnecessary, the air supply branch 200 is switched off, and at this point, the refrigerant accumulated in the air supply branch 200 due to the previous operation is introduced into the air intake of the compressor 110 through the pressure balance branch 300, to participate in the normal working cycle. It should be noted that, if the pressure balance branch 300 is a branch that cannot be switched off, even when the air supply and enthalpy increase are required, a part of refrigerant may also be introduced into the air intake of the compressor 110 through the pressure balance branch 300, which is also conducive to improving the degree of superheat of the air intake of the compressor.

In an implementation, the air supply branch 200, from upstream to downstream, sequentially includes: a throttling section 210, a heat regeneration section 220, and a check section 230. The throttling section 210 is provided with a second throttling element 211 for expanding and throttling the refrigerant flowing into the air supply branch 200; the heat regeneration section 220 flows through the economizer 150, and therefore exchanges heat with the refrigerant, in the major heat exchange loop 100, which flows through the economizer 150; and the check section 230 is provided with a switch valve, which can prevent the refrigerant from flowing back through the air supply inlet of the compressor 110. Based on this objective, a check valve is generally used as the switch valve. Definitely, a solenoid valve or another valve that can shut off the pipeline may be used to serve as the switch valve described here, when considerations such as costs are ignored. It should be known that, when the check valve or another valve having a movable part is used as the switch valve, the vibration and noise reduction effect of the pressure balance branch in this embodiment is especially obvious, this is because, in this case, the valve not only vibrates due to the impact caused by the pressure difference between refrigerants at two sides, but also suffers vibration and noise caused by movement of the movable part. When the solenoid valve or another valve not having a movable part is used as the switch valve, the pressure balance branch in this embodiment can also have a vibration and noise reduction effect, this is mainly because, in this case, the impact vibration caused by the pressure difference between the refrigerants at two sides can be avoided.

The pressure balance branch 300 described in the above embodiment mainly functions to guide the medium-pressure gas-phase refrigerant in the air supply branch 200 to the low-pressure side in the main heat exchange loop 100, thereby eliminating the pressure difference between the two sides of the switch valve to avoid vibration. Based on this principle, in an implementation, the pressure balance branch 300 is a flow path on which a third throttling element is disposed. The refrigerant flowing therethrough can be further throttled before entering the compressor, thus ensuring the reliability of the system. As an example, the third throttling element may be a throttling capillary tube. Here, the model selection of the throttling capillary tube should take the pipeline at the air supply branch side and the pipeline at the low-pressure side of the major heat exchange loop into consideration, and should also consider the convenience of mounting. In an instance, the throttling capillary tube has a diameter of 4 mm and/or a length of 900-1100 mm. At this point, the pressure balance branch 300 may be in a state that cannot be shut off; therefore, in the heating mode requiring air supply and enthalpy increase, this pressure balance branch 300 is switched on similarly, and a part of refrigerant for air supply and enthalpy increase, after being throttled by the pressure balance branch 300, flows to the air intake of the compressor, for improving the degree of superheat of the air intake of the compressor. As another example, the third throttling element is an adjustable throttling element that can adjust the throttling quantity and can switch off the pressure balance branch, for example, an electronic expansion valve. In this case, the pressure balance branch 300 may be in a state that can be shut off; therefore, the pressure balance branch 300 is definitely switched on in the refrigeration mode not requiring air supply and enthalpy increase, and is optionally switched on according to an actual situation in the heating mode requiring air supply and enthalpy increase.

In addition, the pressure balance branch 300 described in the above embodiment is connected from the air supply branch 200 at the upstream of the switch valve to a low-pressure gas-phase refrigerant side of the major heat exchange loop 100. In the embodiment shown in FIG. 1, it is connected to the air intake of the compressor. However, based on its principle, it should be known that there are many optional configurations, as long as the refrigerant here assumes a gas phase and is in a low-pressure state. For example, in the refrigeration mode, the low-pressure gas-phase refrigerant side of the major heat exchange loop 100 includes a section from the air intake of the compressor 110 to the evaporator 160; and in the heating mode, the low-pressure gas-phase refrigerant side of the major heat exchange loop 100 includes a section from the air intake of the compressor 110 to the condenser 130. In other words, in whichever mode, the low-pressure gas-phase refrigerant side of the major heat exchange loop 100 includes a section from the air intake of the compressor 110 to the flow-path switching valve 120. After the above situation is known, in an example, if the pressure balance branch 300 has an adjustable throttling element that can be shut off, the pressure balance branch 300 is connected from the air supply branch 200 at the upstream of the switch valve to the section of the major heat exchange loop 100 from the evaporator 160 to the air intake of the compressor 110. At this point, in the heating mode requiring air supply and enthalpy increase, the pressure balance branch is directly switched off, and it will not be affected by the high pressure of the section from the evaporator 160 to the flow-path switching valve 120. Also, in another example, when the major heat exchange loop 100 further includes a gas-liquid separator 180 connected between the flow-path switching valve 120 and the compressor 110, the pressure balance branch 300 is connected from the air supply branch 200 at the upstream of the switch valve to the section of the major heat exchange loop 100 from the flow-path switching valve 120 to the gas-liquid separator 180. Alternatively, the pressure balance branch 300 is connected from the air supply branch 200 at the upstream of the switch valve to a section of the major heat exchange loop 100 from the air intake of the compressor 110 to the gas-liquid separator 180. If the pressure balance branch 301 is only provided with a throttling capillary tube that cannot be shut off, the pressure balance branch 300 is connected from the air supply branch 200 at the upstream of the switch valve to a section of the major heat exchange loop 100 from the flow-path switching valve 120 to the air intake of the compressor 110. In this case, the pressure balance branch 300 cannot be turned off even in the heating mode; however, as it is connected to the major heat exchange loop 100 at a permanent low-pressure side, the pressure balance branch 300 can continuously work normally, and the introduced refrigerant may be used for improving the degree of superheat of the air intake of the compressor in the low-temperature heating mode.

Optionally, other parts may be added in the system to improve performances of the heat pump system in various aspects. For example, the major heat exchange loop 100 may further include a reservoir 170 connected between the economizer 150 and the evaporator 160, to store the refrigerant that does not need to participate in work temporarily. For another example, the major heat exchange loop 100 may further include a dry filter 190 connected between the condenser 130 and the economizer 150, to dry and filter the refrigerant flowing therethrough.

It should be noted that, in this type of heat pump system, multiple compressors 110 connected in parallel are generally used to provide the refrigeration/heating capability and adjustment range of the system, and the improvement on a related flow path of the economizer in the above embodiment is also applicable to such a situation. At this point, the air supply branch 200 should be connected to air supply inlets of the multiple compressors 110 respectively, and the air supply branch 200 is provided with multiple switch valves corresponding to the multiple compressors 110, to respectively prevent the refrigerant from flowing back.

Optionally, throttling degrees required in the heat pump system in the refrigeration mode and the heating mode are different; therefore, the first throttling element 140 may be configured as a first refrigeration throttling element 140*a* and a first heating throttling element 140*b* that are connected in parallel. In the refrigeration mode, the first heating throttling element 140*b* is turned off; and/or in the heating mode, the first refrigeration throttling element 140*a* is turned off.

Optional implementations of several parts are provided here for selection. The evaporator 160 may be a plate heat exchanger, and the condenser 130 may be a coil heat exchanger.

A control method of a heat pump system is further provided here, for being used with the heat pump system described in the above embodiment or another heat pump system having related features. The control method includes: in a heating mode, enabling a major heat exchange loop 100 to switch on a second flow direction and switch on an air supply branch 200; at this point, a refrigerant, after being compressed by a compressor 110, flowing through a flow direction switching valve to an evaporator 160 for condensation and heat dissipation, and then flowing through an economizer 150; then, on one hand, the refrigerant being throttled by a first throttling element 140, being evaporated at a condenser 130 for heat absorption, and returning to the compressor 110 through the flow direction switching valve; on the other hand, the refrigerant, after being throttled by a second throttling element 211, flowing through the economizer 150 and exchanging heat with the refrigerant flowing from the evaporator 160 to the economizer 150, and then entering an air supply inlet of the compressor 110 through a switch valve; and in a refrigeration mode, enabling the major heat exchange loop 100 to switch on a first flow direction and switch off the air supply branch 200; at this point, on one hand, the refrigerant, after being compressed by the compressor 110, flowing through the flow direction switching valve to the condenser 130 for condensation and heat dissipation, and after being throttled by the first throttling element 140, flowing through the economizer 150, being evaporated at the evaporator 160 for heat absorption, and then returning to the compressor 110 through the flow direction switching valve; on the other hand, the medium-pressure refrigerant accumulated in the air supply branch 200 being throttled by a pressure balance branch 300 and then flowing to a low-pressure gas-phase refrigerant side of the major heat exchange loop 100.

Optionally, in the heating mode, a part of the refrigerant in the air supply branch is throttled by the pressure balance branch and then flows to the low-pressure gas-phase refrigerant side of the major heat exchange loop, to improve the degree of superheat at a suction side of the compressor, and improve the heating performance of the heat pump system.

Optionally, if the heat pump system employs a configuration of double first throttling elements 140, in the refrigeration mode, the refrigerant flows through the first refrigeration throttling element 140*a* for throttling; and/or in the heating mode, the refrigerant flows through the first heating throttling element 140*b* for throttling.

In this embodiment, the major heat exchange loop 100 is enabled to switch on the first flow direction or the second flow direction mainly by changing the flow direction of the flow-path switching valve 120, thereby implementing the refrigeration mode or the heating mode. The air supply branch 200 is switched on or switched off by turning on or off the second throttling element 211.

A working process of the present invention after improvement will be described as follows with reference to FIG. 1 and the above heat pump system and the method embodiment.

In the heating mode, the flow-path switching valve 120 is controlled to switch on the second flow direction of the major heat exchange loop 100, and the second throttling element 211 is controlled to be turned on and an appropriate throttling opening is selected to switch on the air supply branch 200. At this point, the refrigerant is compressed by a compressor 110*a* and a compressor 110*b*, flows through the flow direction switching valve to the evaporator 160 for condensation and heat dissipation, and then flows through the reservoir 170, in which a part of refrigerant that does not participate in work will be accumulated, and the remaining refrigerant continuously flows to the economizer 150. Then, on one hand, the refrigerant is throttled by the first heating throttling element 140*b*, dried and filtered by the dry filter 190, and evaporated at the condenser 130 for heat absorption, and finally the refrigerant flows through the flow direction switching valve and the gas-liquid separator 180 to have the liquid-phase refrigerant separated, and then returns to the compressor 110*a* and the compressor 110*b*, to start a new round of working cycle. On the other hand, the refrigerant is throttled by the second throttling element 211, then flows through the economizer 150 and exchanges heat with the refrigerant flowing from the evaporator 160 to the economizer 150, and then enters air supply inlets of the compressor 110*a* and the compressor 110*b* respectively through check valves 231*a* and 231*b*.

In the refrigerant mode, the flow-path switching valve 120 is controlled to switch on the first flow direction of the major heat exchange loop 100, and the second throttling element 211 is controlled to be turned off to switch off the air supply branch 200. At this point, on one hand, the refrigerant is compressed by the compressor 110*a* and the compressor

110*b*, flows through the flow direction switching valve to the condenser 130 for condensation and heat dissipation, dried and filtered by the dry filter 190, throttled by the first refrigeration throttling element 140*a*, and then flows to the economizer 15. The refrigerant that cannot participate in work is then accumulated in the reservoir 170, and the remaining refrigerant continuously flows to the evaporator 160 for evaporation and heat absorption, and finally the refrigerant flows through the flow direction switching valve and the gas-liquid separator 180 to have the liquid-phase refrigerant separated, and then returns to the compressor 110*a* and the compressor 110*b*, to start a new round of working cycle. On the other hand, the medium-pressure refrigerant accumulated in the air supply branch 200, due to the above operation or another reason, is throttled by the pressure balance branch 300 and then flows to the air intakes of the compressor 110*a* and the compressor 110*b* of the major heat exchange loop 100, and is sucked into the compressors to jointly participate in the working cycle.

It should be understood that, in the descriptions of the present invention, orientation or position relationships indicated by terms such as "upper", "lower", "front", "back", "left" and "right" are orientation or position relationships shown based on the accompanying drawings, and are merely used to facilitate description of the present invention and simplify the description, instead of indicating or implying that the specified apparatus or feature must have the specific orientations or must be constructed and operated in specific orientations, and therefore, they cannot be considered as limitations on the present invention. In the present invention, the high-pressure, medium-pressure and low-pressure refrigerants are relative pressure comparisons of the refrigerant participating in the refrigeration or heating cycle in various working processes, and it is unnecessary to limit specific numeral ranges. For example, the refrigerant at the air intake of the compressor in the heat pump system is generally the low-pressure gas-phase refrigerant, the refrigerant at an exhaust vent of the compressor is generally the high-pressure gas-phase refrigerant, the refrigerant in the air supply branch is generally the medium-pressure gas-phase refrigerant, and the like. This is because the pressure of the gas-phase refrigerant at the exhaust vent of the compressor is greater than that of the refrigerant existing in the air supply branch, while the pressure of the refrigerant existing in the air supply branch is greater than that of the low-pressure refrigerant at the air intake of the compressor. Specific numeral ranges thereof may vary with multiple parameters such as the type of the refrigerant used and the power of the unit. This is understandable for those of ordinary skill in the art.

The heat pump system and the control method thereof in the present invention are mainly illustrated in the above examples. Some implementations of the present invention are described; however, those of ordinary skill in the art should understand that the present invention may be implemented in many other forms without departing from the substance and scope thereof. Therefore, the illustrated examples and implementations are considered as schematic instead of limitative, and the present invention may incorporate various modifications and replacements without departing from the spirit and scope of the present invention as defined in the appended claims.

The invention claimed is:

1. A heat pump system, comprising:

a major heat exchange loop, comprising at least one compressor, a flow-path switching valve, a condenser, a first throttling element, an economizer, and an evaporator that are connected sequentially to form a loop; and an air supply branch, which is connected from a flow path between the first throttling element and the economizer to an air supply inlet of the compressor, the air supply branch being provided with a switch valve for preventing a gas-phase refrigerant from flowing back;

wherein a pressure balance branch is further comprised, which is connected from the air supply branch at the upstream of the switch valve to a low-pressure gas-phase refrigerant side of the major heat exchange loop;

wherein the major heat exchange loop further comprises a gas-liquid separator connected between the flow-path switching valve and the compressor;

wherein the pressure balance branch is connected from the air supply branch at the upstream of the switch valve to a section of the major heat exchange loop from an air intake of the compressor to the gas-liquid separator.

2. The heat pump system according to claim 1, wherein the air supply branch, from upstream to downstream, sequentially comprises:

a throttling section, provided with a second throttling element;

a heat regeneration section, which flows through the economizer, and exchanges heat with a refrigerant, in the major heat exchange loop, which flows through the economizer; and a check section, on which the switch valve is disposed.

3. The heat pump system according to claim 1, wherein the pressure balance branch is a flow path on which a third throttling element is disposed.

4. The heat pump system according to claim 3, wherein the third throttling element is a throttling capillary tube.

5. The heat pump system according to claim 4, wherein the pressure balance branch is connected from the air supply branch at the upstream of the switch valve to a section of the major heat exchange loop from the flow-path switching valve to an air intake of the compressor.

6. The heat pump system according to claim 3, wherein the third throttling element is an adjustable throttling element that can adjust the throttling quantity and can switch off the pressure balance branch.

7. The heat pump system according to claim 6, wherein the pressure balance branch is connected from the air supply branch at the upstream of the switch valve to a section of the major heat exchange loop from the evaporator to an air intake of the compressor.

8. The heat pump system according to claim 1, wherein the major heat exchange loop further comprises a reservoir connected between the economizer and the evaporator.

9. The heat pump system according to claim 1, wherein the major heat exchange loop further comprises a gas-liquid separator connected between the flow-path switching valve and the compressor.

10. The heat pump system according to claim 1, wherein the major heat exchange loop further comprises a dry filter connected between the condenser and the economizer.

11. The heat pump system according to claim 1, wherein the major heat exchange loop comprises multiple compressors connected in parallel.

12. The heat pump system according to claim 11, wherein the air supply branch is connected to air supply inlets of the multiple compressors respectively, and the air supply branch is provided with multiple switch valves corresponding to the multiple compressors.

13. The heat pump system according to claim 1, wherein the first throttling element comprises a first refrigeration throttling element and a first heating throttling element that are connected in parallel; in the refrigeration mode, the first heating throttling element is turned off; and/or in the heating mode, the first refrigeration throttling element is turned off.

14. The heat pump system according to claim 1, wherein the evaporator is a plate heat exchanger.

15. The heat pump system according to claim 1, wherein the condenser is a coil heat exchanger.

16. The heat pump system according to claim 1, wherein the switch valve is a check valve, for preventing the refrigerant from flowing back through the air supply inlet of the compressor.

17. A heat pump system, comprising:

a major heat exchange loop, comprising at least one compressor, a flow-path switching valve, a condenser, a first throttling element, an economizer, and an evaporator that are connected sequentially to form a loop; and an air supply branch, which is connected from a flow path between the first throttling element and the economizer to an air supply inlet of the compressor, the air supply branch being provided with a switch valve for preventing a gas-phase refrigerant from flowing back;

wherein a pressure balance branch is further comprised, which is connected from the air supply branch at the upstream of the switch valve to a low-pressure gas-phase refrigerant side of the major heat exchange loop;

wherein:

in a heating mode, enabling the major heat exchange loop to switch on a second flow direction and switch on the air supply branch; at this point, a refrigerant, after being compressed by the compressor, flowing through a flow direction switching valve to the evaporator for condensation and heat dissipation, and then flowing through the economizer;

then, on one hand, the refrigerant being throttled by the first throttling element, being evaporated at the condenser for heat absorption, and returning to the compressor through the flow direction switching valve; on the other hand, the refrigerant, after being throttled by a second throttling element, flowing through the economizer and exchanging heat with the refrigerant flowing from the evaporator to the economizer, and then entering the air supply inlet of the compressor through the switch valve; and in a refrigeration mode, enabling the major heat exchange loop to switch on a first flow direction and switch off the air supply branch; at this point, on one hand, the refrigerant, after being compressed by the compressor, flowing through the flow direction switching valve to the condenser for condensation and heat dissipation, and after being throttled by the first throttling element, flowing through the economizer, being evaporated at the evaporator for heat absorption, and then returning to the compressor through the flow direction switching valve; on the other hand, the medium-pressure refrigerant accumulated in the air supply branch being throttled by the pressure balance branch and then flowing to a low-pressure gas-phase refrigerant side of the major heat exchange loop.

18. The heat pump system according to claim 17, further comprising: in the heating mode, a part of the refrigerant in the air supply branch being throttled by the pressure balance branch and then flowing to the low-pressure gas-phase refrigerant side of the major heat exchange loop, to improve the degree of superheat at a suction side of the compressor.

19. The heat pump system according to claim 17, wherein the major heat exchange loop is enabled to switch on the first flow direction or the second flow direction by making the flow-path switching valve switch a flow direction.

20. The heat pump system according to claim 17, wherein the air supply branch is switched on or off through turning on/off the second throttling element.

* * * * *